US008893698B2

(12) United States Patent
Boehner

(10) Patent No.: US 8,893,698 B2
(45) Date of Patent: Nov. 25, 2014

(54) SYSTEM AND METHOD TO PITCH SOCCER BALLS

(71) Applicant: Douglas L. Boehner, Verdi, NV (US)

(72) Inventor: Douglas L. Boehner, Verdi, NV (US)

(73) Assignee: Sports Attack, Inc., Verdi, NV (US)

( * ) Notice: Subject to any disclaimer, the term of this patent is extended or adjusted under 35 U.S.C. 154(b) by 36 days.

(21) Appl. No.: 13/800,048

(22) Filed: Mar. 13, 2013

(65) Prior Publication Data

US 2014/0261362 A1 Sep. 18, 2014

(51) Int. Cl.
*F41B 4/00* (2006.01)
*A63B 69/40* (2006.01)
*A63B 69/00* (2006.01)

(52) U.S. Cl.
CPC ..... *A63B 69/406* (2013.01); *A63B 69/002* (2013.01)
USPC ..... 124/78

(58) Field of Classification Search
USPC ..... 124/6, 78
See application file for complete search history.

(56) References Cited

U.S. PATENT DOCUMENTS 3,538,900 A * 11/1970 Samuels ..... 124/78
4,352,348 A 10/1982 Griffith
4,632,088 A * 12/1986 Bruce ..... 124/78
4,834,060 A * 5/1989 Greene ..... 124/78
4,922,885 A * 5/1990 Iwabuchi et al. ..... 124/78
5,437,261 A * 8/1995 Paulson et al. ..... 124/78
5,464,208 A * 11/1995 Pierce ..... 473/451
5,911,214 A 6/1999 Andrews
6,488,020 B1 12/2002 Rosas-Magallan
D626,611 S 11/2010 Magnone
7,882,831 B2 2/2011 Alger
8,342,162 B2 1/2013 Alger

* cited by examiner

*Primary Examiner* — John Ricci
(74) *Attorney, Agent, or Firm* — Watson Rounds; Marc D. Foodman

(57) ABSTRACT

A system and method for pitching balls, particularly round balls such as soccer balls. The system and method are flexibly designed to simulate different types of pitches including but not limited to kicks, throws, and headers. A main frame has a frame with a front panel, a rear panel and a top panel. A tubular chute is rotatably mounted in the interior portion of the main frame with a set of bearings. A pair of opposing ball throwing wheels are fitted to the rotatable tubular chute for launching the ball from the chute. Each wheel is driven by a variable speed motor that is controlled by a variable switch mounted to the main frame. A pair of caddy wheels is attached to the main frame for portability of the apparatus, along with a rear support having an adjustable extension to vary the height and angle of the rotatable tubular chute to adjust the trajectory of the ball. A ball feed chute is mounted to the main frame onto which balls are loaded to be pitched.

31 Claims, 7 Drawing Sheets

SYSTEM AND METHOD TO PITCH SOCCER BALLS

COPYRIGHT NOTICE

Portions of this disclosure contain material in which copyright is claimed by the applicant. The applicant has no objection to the copying of this material in the course of making copies of the application file or any patents that may issue on the application, but all other rights whatsoever in the copyrighted material are reserved.

BACKGROUND

This invention relates to devices and methods for practicing sports that use balls. In particular, the invention relates to simulating kicked, thrown, or headed soccer balls, or other types of balls of a similar shape such as dodge balls.

Practicing receiving passes and other pitches of a ball in soccer is difficult because it is hard to pitch balls on a repetitive basis with particular spins and delivery trajectories. Even the most skilled of players find it challenging to get a reasonable number of repetitions with the qualities required for training. Providing repetitions for an entire team would be impossible without a pitching device. As soccer and other ball sport clinics have proliferated, the demand for repetitive quality kicks has increased even further where skill training must be provided for hundreds of younger inexperienced players at one session. This quality repetition must also be available for even the most skilled of players, including professionals. Further, since soccer drills involve different positions they take place in different areas of the field requiring a device that can provide repetitive quality kicks that can be moved quickly and easily. Portability is critical. Portability and movability are also important in rolling such a device to storage sheds or to vehicles to be transported.

Currently, there are a number of devices on the market for simulating the kicking of a soccer ball for players to practice receiving kicked passes. For purposes of this disclosure, the term "soccer ball" will refer to a ball that is round shaped including a dodge ball or other round ball that is of a similar size, and the terms "kicking," "throwing," "pitching," "passing" and "heading" are used interchangeably to generally describe the motion of propelling a soccer ball. Typically, soccer ball throwing devices have two spinning opposing wheels that engage the ball as it passes through the wheels and impart speed and spiral spin to the ball. These opposing wheels can be adjustably rotated in unison around a central axis to cause the ball to spin in a particular direction simulating a pass curving to the right, to the left or in a straight-ahead motion. This allows for the simulation of a right-footed kicker or a left footed kicker and the degree of spin that is imparted to the ball when it is kicked, thrown or headed.

A problem with prior art soccer ball pitching devices is that they tend to have severe drawbacks in that they do not offer a stable platform that can replicate ball flight in a reliably consistent manner over a significant number of pitches without failure.

SUMMARY

The present invention provides an apparatus and method for throwing soccer or other round balls that may be presented to a player or groups of players in need of rapid repetition in individual and team drills that are difficult to manually replicate repeatedly. The apparatus for pitching balls includes a main frame that comprises a front panel, a rear panel and a top panel. A rotatable tubular chute is mounted in the main frame using a set of bearings. A pair of opposing ball throwing wheels are fitted to the chute for launching the ball from the chute. Each wheel is driven by a variable speed motor that is controlled by a variable switch mounted to the main frame. A pair of caddy wheels is attached to the main frame for portability of the device, along with a rear leg having an adjustable extension to vary the height and angle of the chute to adjust the trajectory of the ball. A ball feed chute is mounted to the exterior side of the main frame onto which balls are loaded to be pitched.

BRIEF DESCRIPTION OF THE DRAWINGS

For a better understanding of the present invention, and to show more clearly how it is configured and functions, reference will now be made, by way of example, to the accompanying drawings. The drawings show embodiments of the present invention in which.

DETAILED DESCRIPTION

Figure 1:
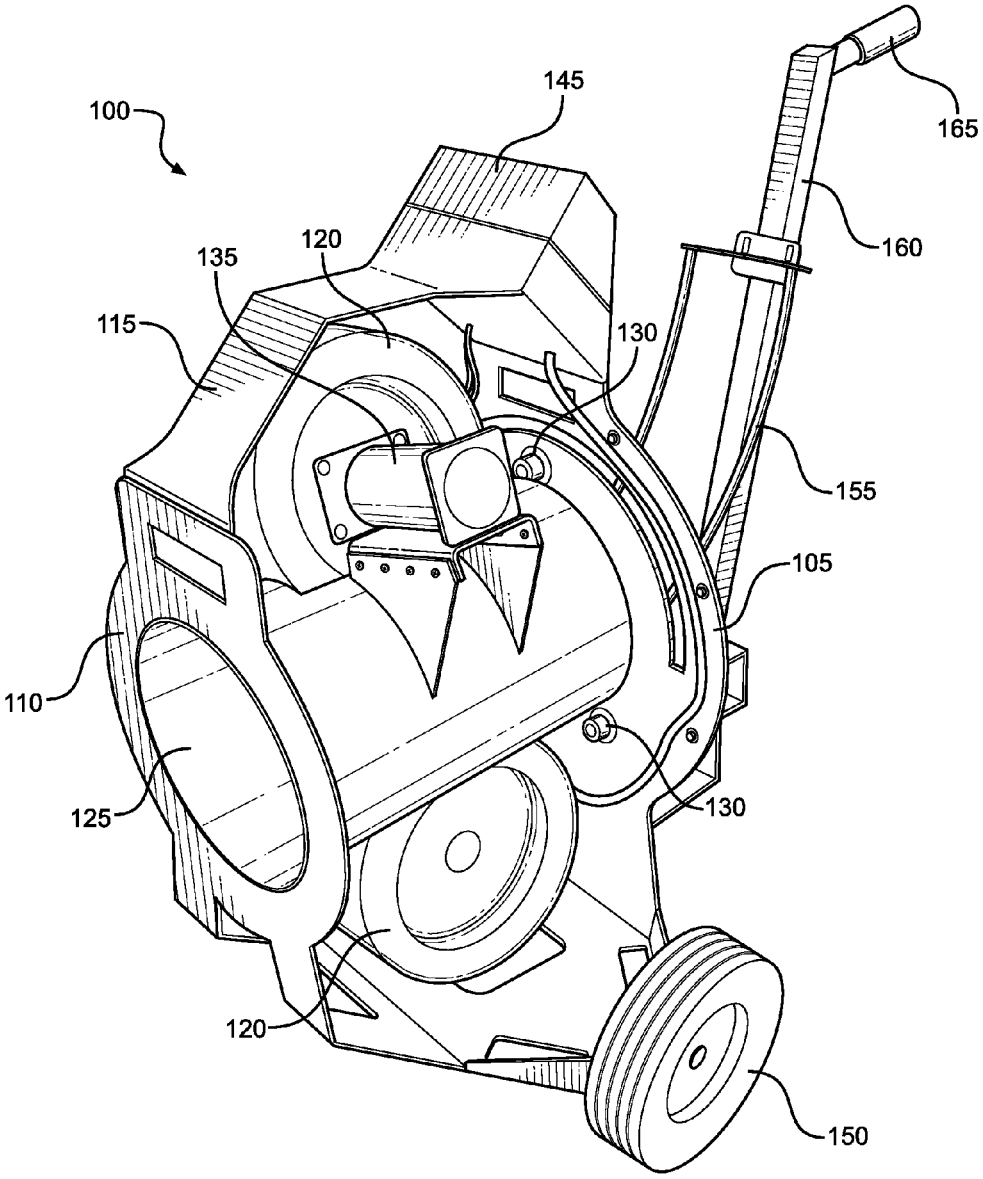
FIG. 1 is a front perspective view of a device to pitch balls.

FIG. 1 is a front perspective view of a ball pitching machine 100. Ball pitching machine 100 has a main frame made up of a rear panel 105, a front panel 110 and a top panel 115. A pair of opposing ball throwing wheels 120 are mounted on either side of a rotatable tubular chute 125 that is seated in the main frame with a set of bearings 130. Ball throwing wheels 120 preferably include a concave outer edge 710 (see FIG. 7A) to improve grip on a ball passing through chute 125. Ball throwing wheels 120 are fitted to chute 125 for launching the ball from chute 125. Each wheel 120 is driven by a variable speed motor 135 that is controlled by a variable switch 140 (See FIG. 4) located in a control box 145 mounted to top panel 115 of the main frame. A pair of caddy wheels 150 is attached to the rear panel 105 of the main frame for portability of machine 100. A rear assembly 800 (See FIGS. 8A-C) having a rear leg with an adjustable extension to vary the height and angle of chute 125 is used to adjust the trajectory of the ball. Ball feed chute 155 is mounted to rear assembly 800 between extendible leg 160 with handle 165 and rear panel 105 of the main frame. Balls are loaded onto ball feed chute 155 to be pitched. A DC source such as a battery (see FIG. 8A) or an AC source is used to power motors 135.

The design of the main frame as described and shown forms an interior portion that surrounds rotatable tubular chute 125 and the throwing mechanism, and eliminates the need for a cantilevered overhang of chute 125 from which the ball exits at high speed. This provides machine 100 with a balanced and stable design that reduces kickback and absorbs the impact of the ball being launched.

Figure 3:
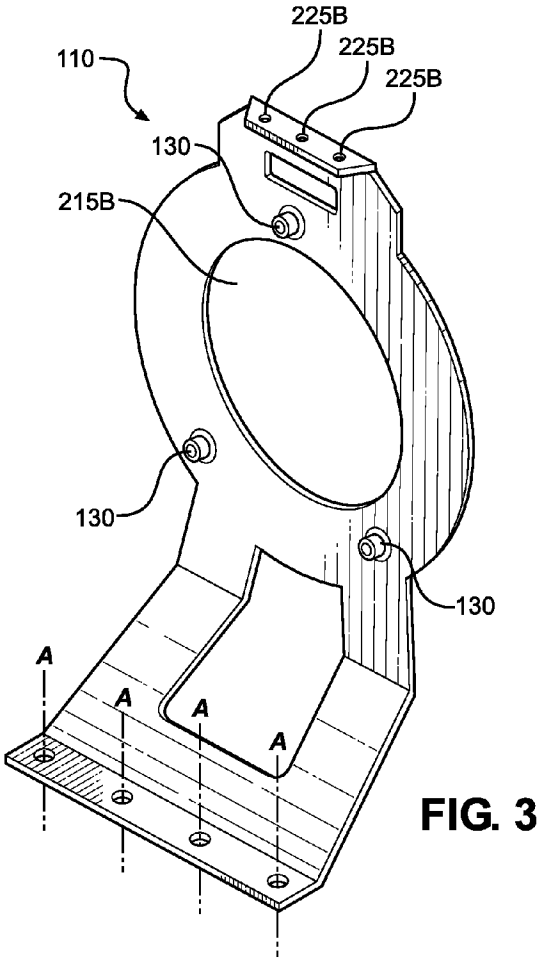
FIG. 3 is a perspective view of a front panel of the frame of a device to pitch balls.
Figure 2:
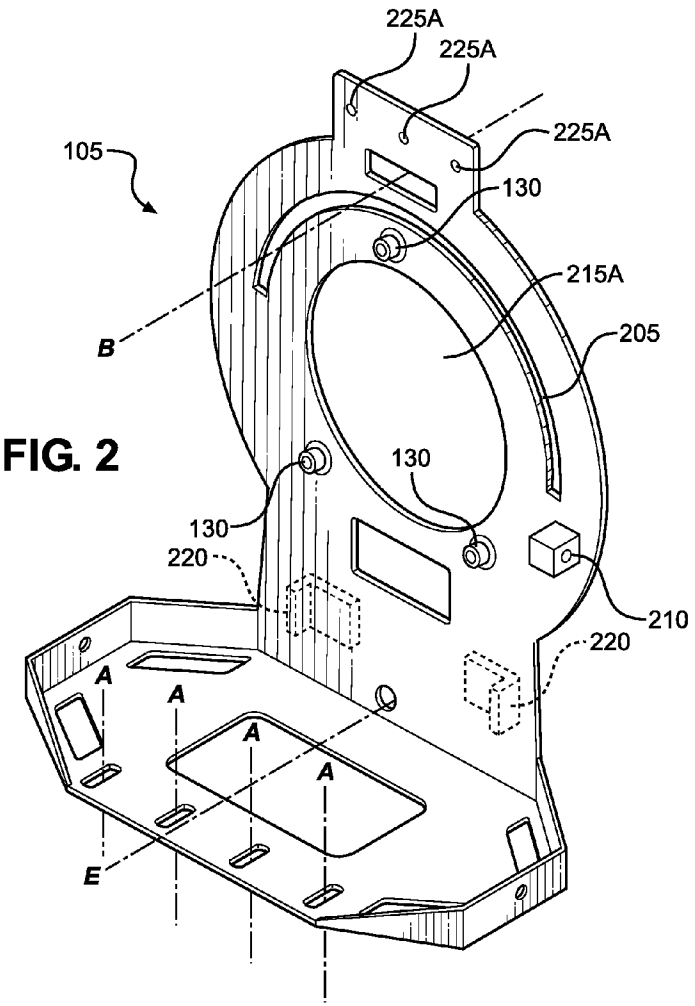
FIG. 2 is a perspective view of a rear panel of the frame of a device to pitch balls.

FIGS. 2 and 3 show perspective views of rear panel 105 and front panel 110 respectively. Rear panel 105 has a base portion that forms the bottom of the main frame. A ball spin axis slot 205 allows for tubular chute 125 to be rotated to adjust the directional spin of a ball being pitched from machine 100. Bearings 130 are positioned around the outside of rotatable tubular chute 125 on panels 105, 110 to hold rotatable tubular chute 125 in place and facilitate rotation. The number of bearings 130 may be any number that is appropriate to hold chute 125 in place and ease rotation. It has been found that including, for example, six bearings 130 function well with three on rear panel 105 and three on front panel 110 configured with two bearings below and supporting rotatable tubular chute 125 on each panel and one above chute 125 on each panel to effectively centers tubular chute 125 in the main frame. A wire clamp 210 holds control wires in place that run from control box 145 to motors 135.

Rear panel 105 and front panel 110 have corresponding openings 215*a, b* which align with rotatable tubular chute 125 when the main frame is assembled and through which a ball passes to be pitched. Front panel 110 is attached to rear panel by a set of screws or rivets at attachment points "A" on each panel. Extendible leg 160 is also attached to rear panel 105 at leg attachment points 220 and top panel 115 is attached between rear panel at attachment points 225*a* and front panel 110 at attachment points 225*b*.

Figure 4:
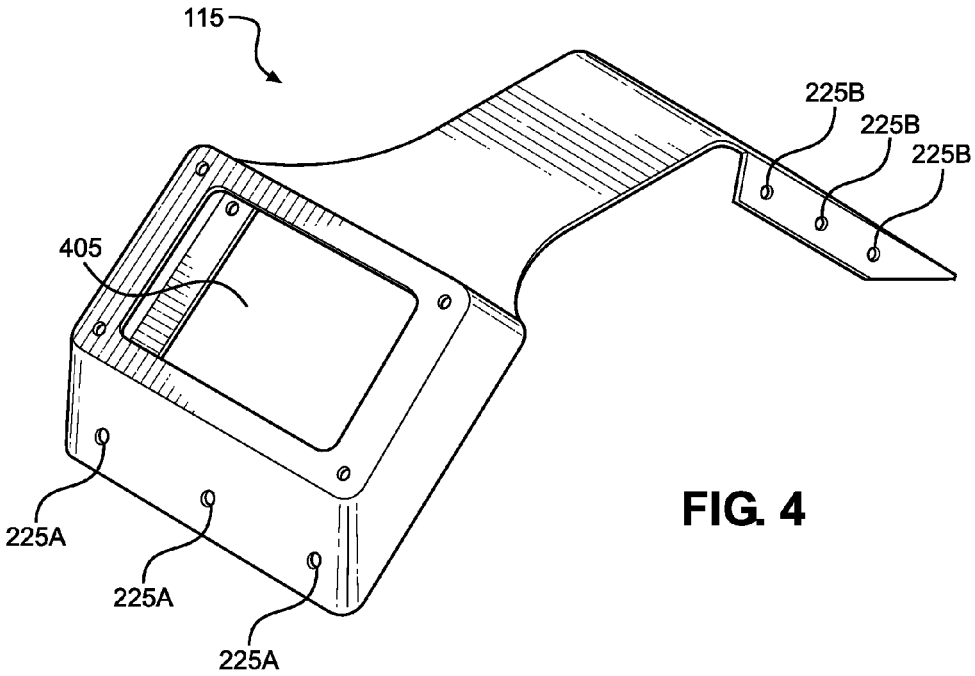
FIG. 4 is a perspective view of a top panel of the frame of a device to pitch balls.

FIG. 4 is a perspective view of top panel 115. Attachment points 225*a*, 225*b* are shown where top panel 115 is attached to rear panel 105 and front panel 110 respectively. In addition, an opening 405 is shown where control box 145 mounts to top panel 110.

Figure 5:
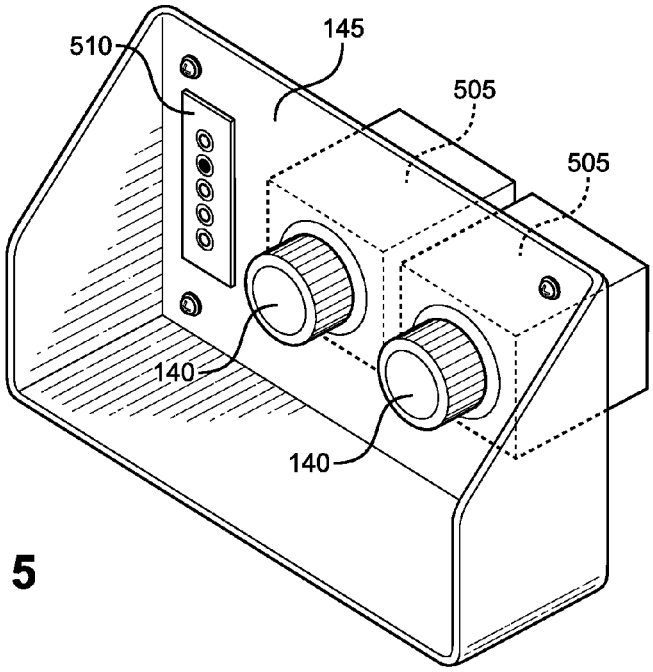
FIG. 5 is a perspective view of a control box of a device to pitch balls.

FIG. 5 is a perspective view of control box 145 which mounts to top panel 115. In control box 145 is a pair of electronic variable switch knobs 140, each of which provides input to a corresponding electronic controller 505. Each controller 505, in turn, controls the speed of a corresponding variable speed motor 135 for pitching the ball from rotatable tubular chute 125. In the embodiment of FIG. 4, switches 140 are shown as dials, but it should be understood that switches 140 may be replaced with any type of adjustable switch including but not limited to a sliding switch, a push button switch, or an electronic switch. As the speed of motors 135 is increased, the distance and spin of the ball pitched from chute 125 is increased. A power source gauge 510 is included in control box 145 for indicating to an operator of machine 100 the level of charge left in the battery that powers motors 135.

Figure 6:
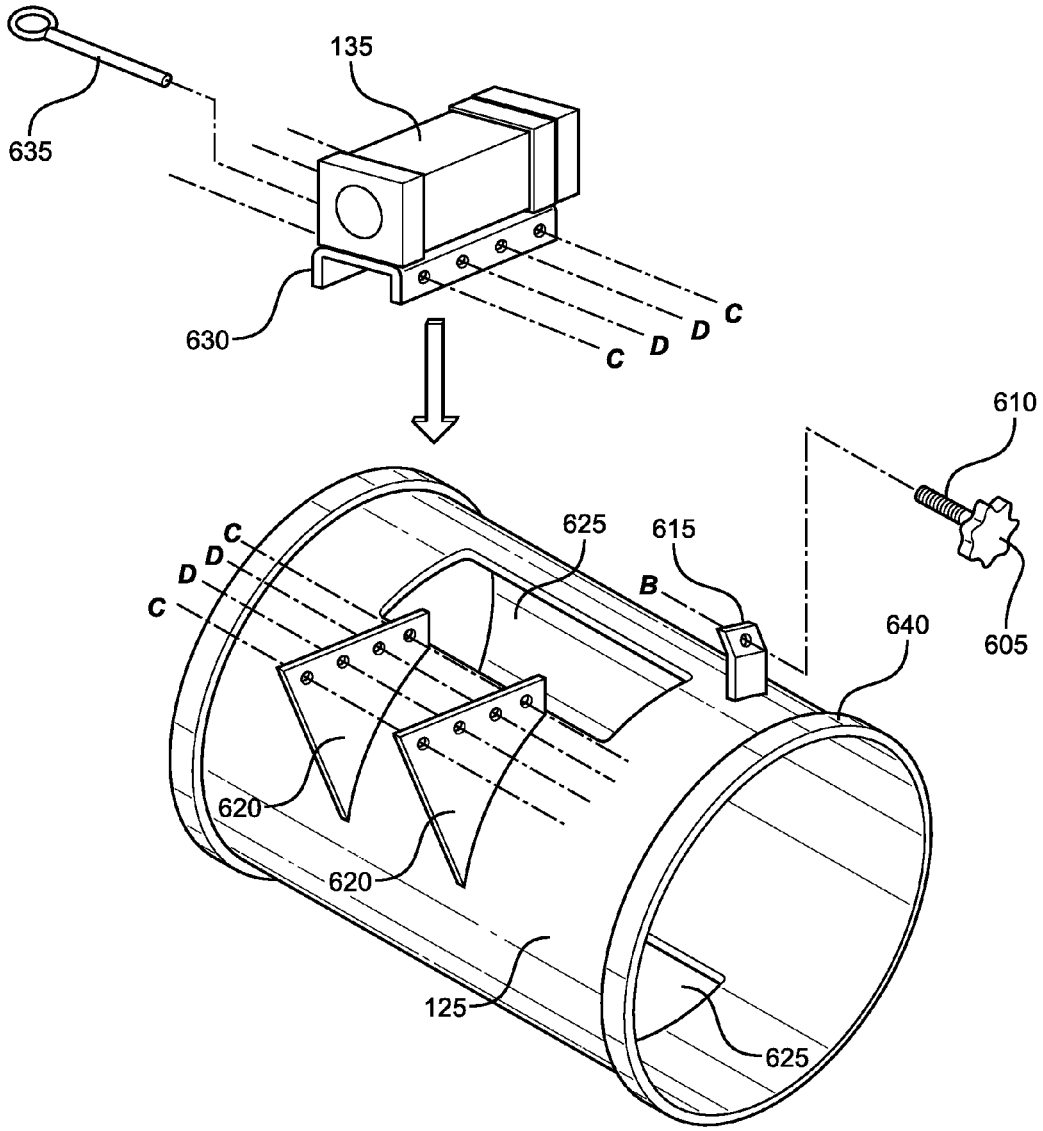
FIG. 6 is a cut-away perspective view of a rotatable tubular chute of a device to pitch balls.

FIG. 6 is a cut-away perspective view of rotatable tubular chute 125 of machine 100. A spin axis handle 605 with a screw 610 passes through rear ball spin axis slot 205 on rear panel 105 and is threaded into spin lock flange 615 mounted on the side of chute 125. When handle 605 is loose, chute 125 rotates in either direction to adjust the direction of the spin applied to the ball as it exits chute 125. Once an operator has rotated chute 125 into the desired position, handle 605 is turned to tighten screw 610 in spin lock flange 615 and lock chute 125 into that position. The rotational position of chute 125 is infinitely adjustable in spin axis slot 205. With chute 125 locked in position, the direction of spin is repeated for all balls pitched until chute 125 is adjusted to a new position.

Mounted on chute 125 are four motor mount flanges 620, two of which are visible on the outside of chute 125 in FIG. 6, in close proximity to throwing wheel aperture 625 through which a portion of throwing wheel 120 extends to contact a ball passing through chute 125. A second pair of motor mount flanges 620 are positioned on the opposite side of chute 125 in close proximity to a second throwing wheel aperture 625. Mounted to each pair of motor mount flanges 620 is a motor mount plate 630. Plate 630 has adjustment holes "C" so that motors 135 may be moved in one direction or the other to further extend or pull back throwing wheels 120 through apertures 625. Adjusting the position of throwing wheels 120 increases or decreases the pressure of ball throwing wheels 120 or the pinch applied between throwing wheels 120 to a ball passing through chute 125. Additional holes "D" accept motor mount aligning pin 635, which is positioned accordingly to accommodate different sized balls, or balls of the same size with different levels of air pressure. A motor 135 is attached to each motor mounting plate 630 on which throwing wheels 120 are mounted.

At either end of rotatable tubular chute 125 on the exterior radial surface is affixed a rotation ring 640. Rotation ring 640 may be approximately the width and height of one of the bearings and may be formed of either a rigid metal or plastic material. The use of rotation ring 640 at either end of chute 125 works in conjunction with the surface engaging bearings 130 by providing a truly rounded component to facilitate rotation of rotatable tubular chute 125.

Figure 7A:
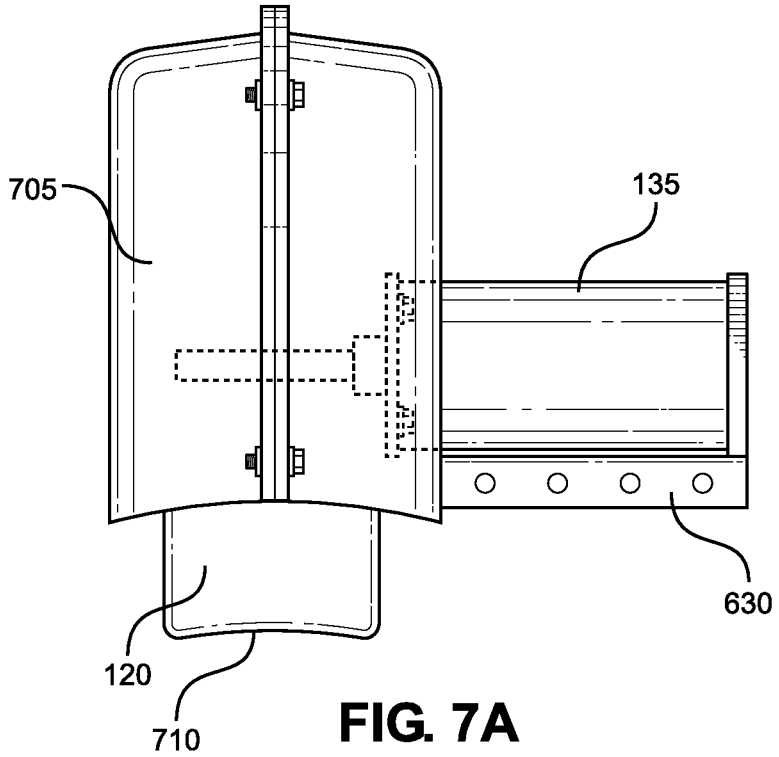
FIGS. 7A-7B are front and side views of a throwing wheel, guard and motor mounting plate of a device to pitch balls.
Figure 7B:
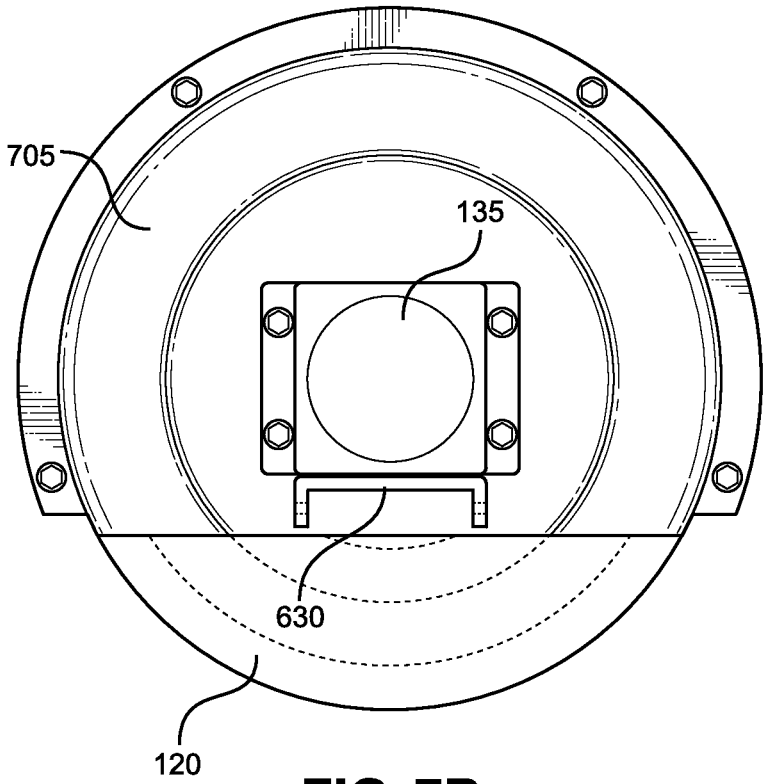

FIGS. 7A and 7B are front and side views of a throwing wheel 120 respectively, throwing wheel guard 705 and motor mounting plate 630 of the device to pitch balls. As is seen in FIG. 7A a throwing wheel 120 attached to the shaft of each motor 135. Each throwing wheel 120 and motor 135 pair is shielded by a throwing wheel guard 705 to protect the operator and anyone else coming near machine 100 when it is in operation and throwing wheels 120 are moving at high speed. With wheel guards 705 in place, the only portion of throwing wheels 120 that is exposed is inside of rotatable tubular chute 125 where the concave edge surface 710 of throwing wheels 120 contacts and launches a ball passing through rotatable tubular chute 125.

Figure 8A:
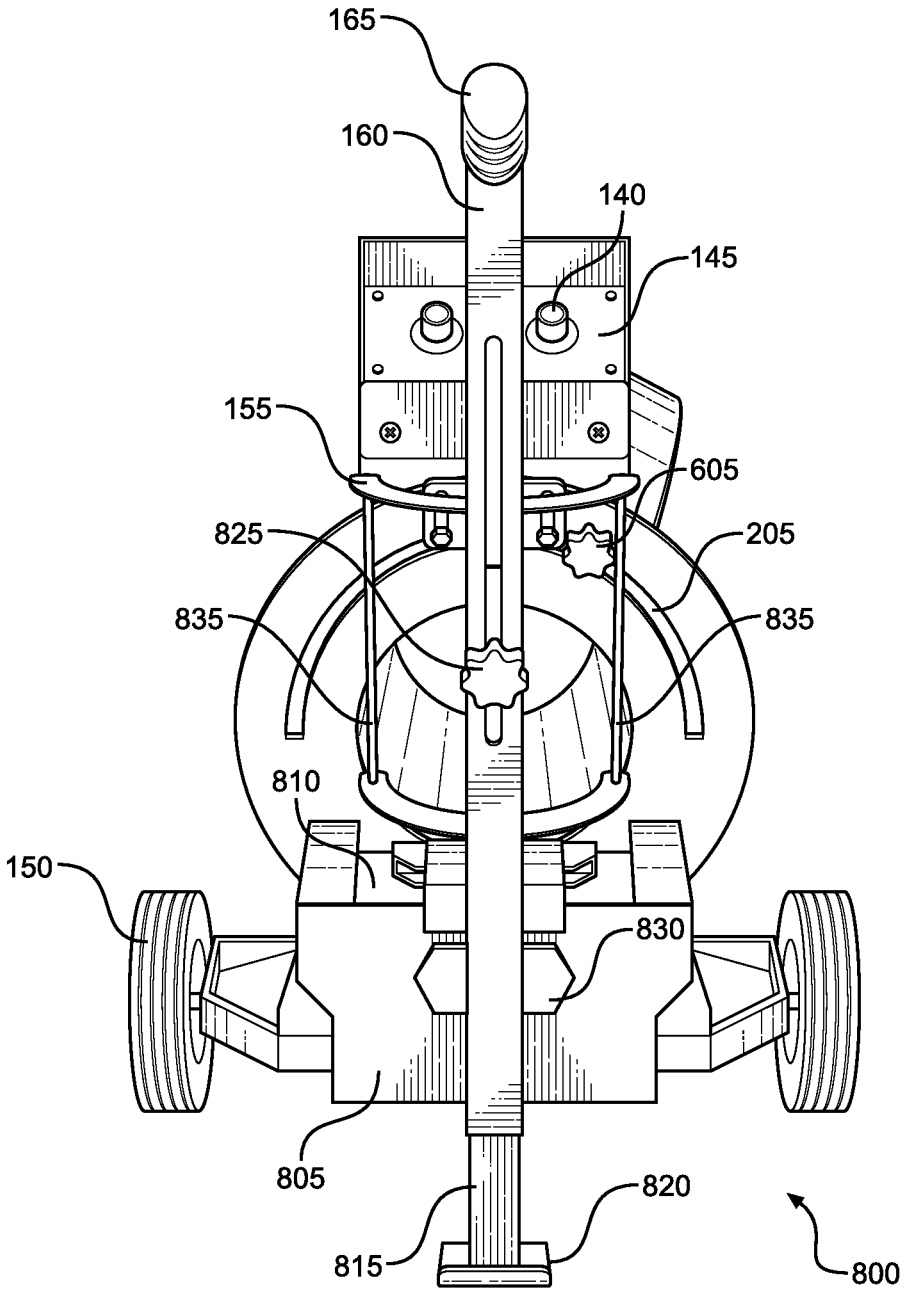
FIG. 8A is a view of the rear assembly on a device to pitch balls.
Figure 8C:
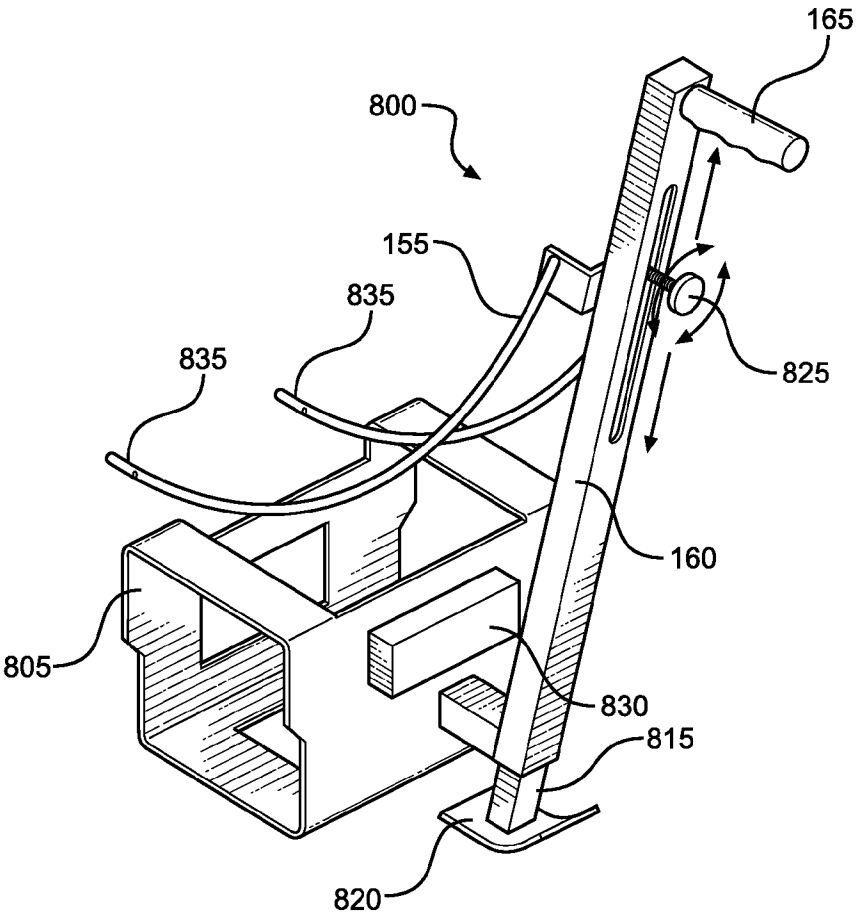
FIGS. 8B-8C are side and perspective views of a rear assembly on a device to pitch balls.
Figure 8B:
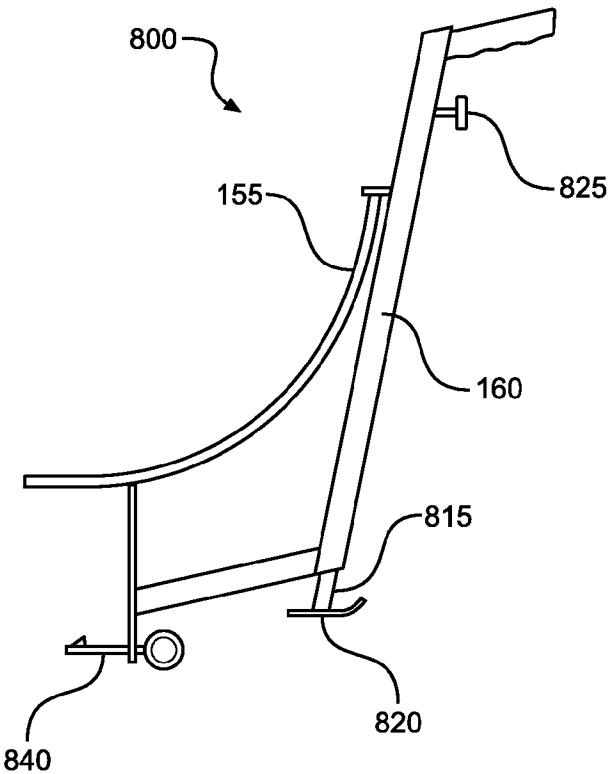

FIGS. 8A-8C show views of rear assembly 800 on the device to pitch balls. Rear assembly 800 has a housing 805 for holding a power source 810 such as a 12 volt battery for powering motors 135. The battery may be the type used in an automobile and may be rechargeable using a charging attachment 830 that may be built into housing 805 and may be plugged into a standard 120 volt AC wall outlet (cord not shown) when machine 100 is not in use. A removable and adjustable rear leg 160 has an extension 815 with a foot 820 that telescopes from the bottom of leg 160 by loosening and then tightening handle 825. Raising or lowering leg extension 815 adjusts the angle of chute 125 and, in turn, the trajectory of the ball as it exits rotatable tubular chute 125. Handle 165 is used to facilitate the rolling of machine 100. Ball feed chute 155 is used to load balls which roll down chute 155 and into tubular chute 125 to be pitched. Handle 605 for adjusting the rotational angle of tubular chute 125 is also visible in spin axis slot 205, as is control box 145 and control knob 140.

Detachment of rear assembly 800 from rear panel 105 is accomplished by tilting machine 100 onto the angled front portion of top frame 115. Once machine 100 is tilted, quick pin 840 is released and engagement clips (not shown) on the front of housing 805 are slid out of attachment points 220 on rear panel 105. Ball feed chute 155, which includes a pair of curved roller rods 835 on which a ball descends into chute 125 are attached to leg 160 and housing 805. The entire rear assembly 800 may be quickly and easily removed for portability and transport.

A camera (not shown) may be used to capture either or both still images and/or video recordings of players receiving balls pitched by ball pitching machine 100. A controller connected to a sensor on motors 135 can transmit signals to the camera at a time when a ball is sensed to turn on as a ball is being pitched through and including a time period for reception of a pitch. A series of still images or a video recording may later be reviewed and analyzed by coaches and players so that a player can improve different aspects of play. The images may be stored on the camera or in a memory connected to the controller where they may be accessed through a connection port such as a standard USB port, or connected for transmission over a network as desired by a user.

The operation of machine 100 will now be described. First, the operator turns on machine 100 using variable switches 140. Each motor 135 is adjusted to the desired speed using switches 140. If both motors 135 are set to the same speed, the ball being pitched will have no spin. If one motor is spinning faster than the other motor, spin will be imparted to the ball as it is launched in a particular direction depending on which motor is spinning faster. The arc of the spin will be greater as the difference in the speeds of the motors is increased. The operator adjusts the axis of spin and the resulting trajectory of the ball by rotating tubular chute 125. This is accomplished by loosening handle 605 and rotating chute 125 on bearings 130 until the desired position of handle 605 is reached in slot 205. Handle 605 is then tightened to hold chute 125 in the desired position. A ball is then placed at the top of ball feed chute 155 where it rolls down on curved roller rods 835 until it reaches opening 215*a* in rear panel. It passes through opening 215*a* and enters tubular chute 125. As it rolls into chute 125 it reaches opposing throwing wheels 120, the edges of which extend through apertures 625 into the cylindrical space within rotatable tubular chute 125. As the ball passes between opposing throwing wheels 120 in chute 125, it is pinched and pitched by the action of wheels 120 out through chute 125 and through opening 215*b* in front panel 110.

While the invention has been described with respect to the FIGS. 1-8, it will be appreciated that many modifications and changes may be made by those skilled in the art without departing from the spirit of the invention. Any variation and derivation from the above description and drawings are included in the scope of the present invention as defined by the claims.

The invention claimed is:

1. An apparatus for pitching balls to a player, comprising:
- a tubular chute having a first wheel aperture and a second wheel aperture;
- a frame comprising:
  - an interior portion in which the tubular chute is positioned;
  - a first end with a first aperture; and
  - a second end with a second aperture; and
  - a stabilizing bottom portion affixed to the first end and the second end and comprising at least one section generally parallel to the ground extending laterally outside a diameter of the tubular chute;
- a first throwing wheel powered by a first motor, at least a portion of the first throwing wheel extending through the first wheel aperture in the rotatable tubular chute;
- a second throwing wheel powered by a second motor, at least a portion of the second throwing wheel extending through the second wheel aperture in the rotatable tubular chute substantially opposite the first throwing wheel; and
- a support attached to an end of the frame.

2. The apparatus of claim 1 further comprising a ball feed chute proximate the frame from which a ball rolls into the rotatable tubular chute.

3. The apparatus of claim 1 wherein the support further comprises an extension for extending the support and thereby adjusting the trajectory of a ball exiting the rotatable tubular chute.

4. The apparatus of claim 3 further comprising at least one removably attachable bracket for facilitating removal of the support from the apparatus.

5. The apparatus of claim 4 wherein the frame comprises an angled section at the second end on which the apparatus may be tilted to detach the at least one bracket securing the support.

6. The apparatus of claim 1 wherein the first and second throwing wheels may be adjusted inwardly or outwardly to accommodate different size balls passing through the rotatable tubular chute.

7. The apparatus of claim 1 further comprising a set of ball bearings positioned relative to the frame on which the rotatable tubular chute rotates to adjust the axis of spin imparted to a ball exiting the rotatable tubular chute.

8. The apparatus of claim 7 further comprising a first ring affixed to and surrounding an exterior surface at a first end of the rotatable tubular chute, and a second ring affixed to and surrounding an exterior surface at a second end of the rotatable tubular chute to provide a circular surface contacting the bearings.

9. The apparatus of claim 1 further comprising a power source that is from the group comprising: (a) a direct current (DC) power source that is rechargeable; or (b) an alternating current (AC) power source.

10. The apparatus of claim 9 further comprising a charge indicator to determine the level of charge of the DC power source.

11. The apparatus of claim 10 further comprising a quick connect/disconnect battery charger.

12. The apparatus of claim 1 further comprising a first wheel guard and second wheel guard wherein the first wheel guard is positioned over the first throwing wheel and the second wheel guard is positioned over the second throwing wheel.

13. The apparatus of claim 1, wherein the first and second motors are each an independently variable speed motor controlled to vary a speed of each respective motor.

14. The apparatus of claim 1 further comprising a camera, the camera set to record a first image at or substantially near the time that the ball is pitched wherein the camera is trained on a position where the ball is received.

15. The apparatus of claim 14, wherein the camera records an image defined by at least one of the types: a) a still image; or b) a video recording.

16. The apparatus of claim 1 further comprising a set of caddy wheels attached to the frame for portability and to enable the apparatus to be pivoted on a vertical axis.

17. A method of pitching a ball to a player using a pitching machine having a frame with a first end, a second end and a stabilizing bottom portion affixed to the first end and the second end, comprising the steps of:
- placing a ball on a ball feed chute that is outside of the frame;
- rolling the ball down an inclined section of the ball feed chute;
- passing the ball through an opening in the first end of the frame after exiting the ball feed chute;
- directing the ball into a rotatable tubular chute positioned inside the interior portion of the frame between the first end and the second end of the frame;
- engaging the ball inside the rotatable tubular chute with a pair of opposed throwing wheels each powered by a motor, the exterior edges of the throwing wheels extending into the rotatable tubular chute through a pair of corresponding opposing apertures in the rotatable tubular chute;

pitching the ball through a remaining portion of the rotatable tubular chute and out through an opening in the second end of the frame; and wherein the stabilizing bottom portion comprises at least one section generally parallel to the ground extending laterally outside a diameter of the tubular chute.

18. The method of claim 17 further comprising extending an adjustable support attached to the frame to thereby adjust the trajectory of the ball exiting the rotatable tubular chute.

19. The method of claim 18 further comprising providing a removable attachable bracket for facilitating detachment of the support from the frame.

20. The method of claim 19 wherein the frame comprises an angled section at the second end onto which the frame may be tilted to detach the at least one bracket securing the support.

21. The method of claim 17 wherein the first and second throwing wheels may be adjusted inwardly or outwardly to accommodate different size balls passing through the rotatable tubular chute.

22. The method of claim 17 further comprising providing a set of ball bearings positioned relative to the frame on which the rotatable tubular chute rotates to adjust the axis of spin imparted to a ball exiting the rotatable tubular chute.

23. The method of claim 22 further comprising providing a first ring affixed to and surrounding an exterior surface at a first end of the rotatable tubular chute, and a second ring affixed to and surrounding an exterior surface at a second end of the rotatable tubular chute to provide a circular surface contacting the bearings.

24. The method of claim 17 further comprising providing a power source that is from the group comprising: (a) a direct current (DC) power source that is rechargeable; or (b) an alternating current (AC) power source.

25. The method of claim 24 further comprising providing a charge indicator to determine the level of charge of the DC power source.

26. The method of claim 24 further comprising providing a quick connect/disconnect battery charger.

27. The method of claim 17 further comprising providing a first wheel guard and second wheel guard wherein the first wheel guard is positioned over the first throwing wheel and the second wheel guard is positioned over the second throwing wheel.

28. The method of claim 17, wherein the first and second motors are each an independently variable speed motor controlled to vary a speed of each respective motor.

29. The method of claim 17 further comprising recording a first image at or substantially near the time that the ball is pitched using a camera trained on a position where the ball is received.

30. The method of claim 29 wherein the camera records an image defined by at least one of the types: a) a still image; or b) a video recording.

31. The method of claim 17 further comprising providing a set of caddy wheels for portability and to enable pivoting of the rotatable tubular chute on a vertical axis.

* * * * *